US010010484B2

(12) United States Patent
Muller et al.

(10) Patent No.: US 10,010,484 B2
(45) Date of Patent: Jul. 3, 2018

(54) MULTI-SIZE PILL SPLITTER AND METHODS

(71) Applicant: QUESTA CORPORATION, Marietta, GA (US)

(72) Inventors: Richard B. Muller, Marietta, GA (US); Kenton Fleming, Marietta, GA (US)

(73) Assignee: QUESTA CORPORATION, Marietta, GA (US)

( * ) Notice: Subject to any disclaimer, the term of this patent is extended or adjusted under 35 U.S.C. 154(b) by 110 days.

(21) Appl. No.: 15/128,430

(22) PCT Filed: Apr. 15, 2015

(86) PCT No.: PCT/US2015/025917
§ 371 (c)(1),
(2) Date: Sep. 23, 2016

(87) PCT Pub. No.: WO2015/164142
PCT Pub. Date: Oct. 29, 2015

(65) Prior Publication Data

US 2017/0128324 A1 May 11, 2017

Related U.S. Application Data

(60) Provisional application No. 61/983,965, filed on Apr. 24, 2014.

(51) Int. Cl.

| | |
|---|---|
| ***B26D 1/26*** | (2006.01) |
| ***A61J 7/00*** | (2006.01) |
| ***B26D 3/30*** | (2006.01) |
| *B26D 1/30* | (2006.01) |

(52) U.S. Cl.
CPC ..... *A61J 7/0007* (2013.01); *B26D 1/26* (2013.01); *B26D 3/30* (2013.01); *B26D 1/30* (2013.01)

(58) Field of Classification Search
CPC ..... A61J 7/0007; B26D 1/26
See application file for complete search history.

(56) References Cited

U.S. PATENT DOCUMENTS

| | | | | |
|---|---|---|---|---|
| 2,418,958 A * | 4/1947 | Stock | B26B 27/00 | 225/104 |
| 4,173,826 A * | 11/1979 | Leopoldi | A61J 7/0007 | 225/103 |
| 4,199,863 A * | 4/1980 | Deckert | A61J 7/0007 | 30/124 |
| 4,627,432 A | 12/1986 | Newell et al. | | |
| 4,811,731 A | 3/1989 | Newell et al. | | |
| 4,869,394 A * | 9/1989 | Hurst | G06M 7/02 | 221/186 |

(Continued)

FOREIGN PATENT DOCUMENTS

| | | |
|---|---|---|
| CN | 101259622 A | 9/2008 |
| DE | 19957015 A1 | 6/2001 |

*Primary Examiner* — Sean Michalski
(74) *Attorney, Agent, or Firm* — Deanna L. Baxam, Esq.

(57) ABSTRACT

A pill splitter for cutting pills and tablets of multiple sizes into uniform dosage portions for treating humans or animals comprising a housing, a rotatable pill cassette with multiple pill cavities disposed to hold pills of different sizes, a cover with access ports for removing cut pill portion, and a retractable blade for smoothly cutting pill units with minimal shattering or residue. A method of splitting pills is also provided.

11 Claims, 8 Drawing Sheets

(56) References Cited

U.S. PATENT DOCUMENTS 4,887,755 A 12/1989 Gibilisco
D305,960 S * 2/1990 Wolff ..... G06M 7/02 D24/232
5,118,021 A * 6/1992 Fiocchi ..... A61J 7/0007 225/103
6,557,945 B1 * 5/2003 Eric ..... A61J 7/0007 30/124
7,000,815 B1 * 2/2006 Tipton ..... A61J 7/0007 225/103
7,275,671 B1 10/2007 Reitano
7,503,471 B2 3/2009 Iwasaki
7,828,181 B1 * 11/2010 Reitano ..... B26D 3/30 225/1
8,550,319 B2 10/2013 Raghuprasad
8,590,164 B2 * 11/2013 Noble ..... A61J 7/0007 225/104
D732,950 S * 6/2015 Young ..... A61J 7/0007 D9/418
9,827,165 B1 * 11/2017 Sundt ..... A61J 7/0007
2002/0179669 A1 * 12/2002 Buckley ..... A61J 7/0007 225/103
2006/0201985 A1 * 9/2006 Sze ..... A61J 7/0007 225/104
2007/0164141 A1 * 7/2007 Engel ..... A61J 7/0007 241/169.2
2008/0078797 A1 * 4/2008 Frick ..... A61J 7/0007 225/93
2009/0031872 A1 * 2/2009 Lykam ..... A61J 3/06 83/78
2009/0183373 A1 * 7/2009 Suhr ..... A61J 7/0007 30/124
2011/0271530 A1 * 11/2011 Raghuprasad ..... B26D 3/30 30/124
2014/0311304 A1 * 10/2014 Noble ..... A61J 7/0007 83/13
2014/0361032 A1 * 12/2014 Czarnek ..... A61J 7/02 221/1
2015/0164747 A1 * 6/2015 Li ..... A61J 7/0007 30/124
2015/0209236 A1 * 7/2015 Patel ..... A61J 7/0007 225/103
2015/0217930 A1 * 8/2015 Holmes ..... B65D 83/0454 221/1
2015/0257978 A1 * 9/2015 Smith ..... A61J 7/0007 225/103
2017/0128324 A1 * 5/2017 Muller ..... B26D 1/26
2017/0273868 A1 * 9/2017 Wang ..... A61J 7/0007

* cited by examiner

MULTI-SIZE PILL SPLITTER AND METHODS

This application claims the benefit of priority of U.S. provisional application 61/983,965, filed Apr. 24, 2014.

TECHNICAL FIELD

The invention relates to pill splitters and methods of use. In particular, the invention relates to pill splitters that are used to split pills of varying shapes and sizes. The invention further relates to methods of splitting pills that reduce shattering or fragmentation of the pills.

BACKGROUND

Healthcare professionals may prescribe dosages of medications that require splitting of solid pill or tablet doses, typically in halves. Splitting may be used to divide higher doses of the pill so that the patient may divide one tablet into two doses, or a halved tabled into quarters, etc., thus saving money. Alternatively, a low dose of a medication typically available in a higher dose may also be prescribed. Pill splitting is often used with common medications for treatment of chronic conditions in humans and animals. A very large demographic of consumers are required to take prescription pills for all kinds of reasons. As the global population continues to live longer in both the industrial and emerging countries of the world, the volume of usage of prescription pills will continue to increase.

While some drugs, such as extended release formulations, may not be appropriate for splitting, many tablet doses can be divided for effective therapeutic use. Certain prescription medications may be indicated as approved for splitting in the accompanying prescribing information, or recommended as such by healthcare providers or dispensing pharmacists. Pill splitting is typically not done at pharmacies where drugs are dispensed, but is left to the patient consumer. As a result, there is a need among consumers for devices and methods to efficiently split tablets.

Pills intended for splitting, such as aspirin, may commonly be scored in the middle to provide a breakage line along which the pill may be more easily severed while providing dosage uniformity. Some tablets are excessively hard, which causes the halves to fly apart when the pill is cut. Some pills are not molded in a uniform shape, for example in a diamond shape, which makes it difficult to accurately locate a center line along which the pill can be cut to provide two uniform doses.

Certain problems exist that are common to all pill cutters currently on the market. Many include a V-shaped pill holder arrangement that holds pills of various sizes according to their alignment with the dimensions of the V-configuration. With pill cutters having a single receptacle designed to hold many pill sizes, i.e. "one size fits all," the pill is not held securely in place, resulting in uneven cutting. Additionally such cutters cause many pills to break and/or leave residue. There is therefore a need for a pill cutter that secures multiple sizes of pills for cutting, and which cuts these pills accurately and evenly with minimal breakage, shattering or residue.

Examples of prior art tablet cutters include U.S. Pat. No. 8,590,164, which discloses a tablet cutter with a V-shaped pill holder arrangement for receiving tablets. The pill holder feature includes a slidable feature that includes arms that slide to hold the tablet in place over a slide track through which a blade is passed. U.S. Pat. No. 8,474,674 discloses a tablet cutter with a protected cutting edge, in that a guard slides over the cutting edge when the pill cutter is in an open position, and pulls back to expose the cutting edge when the pill cutter is closed. The tablet holder assembly disclosed by this patent is a V-shaped structure with a narrow end, an open end and centering guides for positioning tablets. V-shaped tablet holder arrangements do not allow for precise and secure accommodation of tablets of varying sizes. U.S. Pat. No. 7,503,471 discloses a tablet cutter formed by a cutting edge mounted on the bottom of a hollow column, in which the hollow column is capped by a transparent plate that prevents the cut halves of the tablet from jumping out of the column and also allows for viewing of the tablet cutting (score) line to align the cutting edge. U.S. Pat. No. 8,550,319 provides a device for cutting multiple tablets at one time that includes multiple blades and tablet nests with beds of different shapes and sizes. In this regard, when a selected tablet nest is inserted into the cutter, the blades facilitate cutting of multiple tablets of the same configuration and size at the same time.

There remains a need for a pill and tablet cutter for consumer use that provides easy selection of the pill size and shape without replacement of any part of the apparatus, and which also provides safe cutting of individual doses for the user's consumption.

SUMMARY OF INVENTION

The invention comprises an apparatus for splitting multiple sizes of pills or tablets, or pill portions, which comprises a cover, an angled or curved edge blade for low-impact slicing of pills that is sheathed for user safety, and a housing that comprises a rotatable disc or cassette having formed therein a number of pill cavities of different shapes and sizes. The housing and cassette form a locking assembly that locks the cassette in place and holds it securely after the desired pill cavity has been positioned beneath the cutting blade. As used herein, the term "pill" should be understood, according to U.S. Food and Drug Administration definitions, to encompass pills, which are small, round solid dosage forms containing a medicinal agent(s) intended for oral administration, as well as tablets, which are solid dosage forms (any shape) containing medicinal substances with or without suitable diluents, of any conventional sizes.

The invention further comprises a pill cutter apparatus that cuts pills of various sizes by providing multiple sizes of pill cavities which can be dissected with a cutting blade. The pill cavities hold the cut halves of the pill and prevent the pieces from flying out of the container or from being projected against the internal walls of the pill cutter. In this manner, the invention minimizes breakage and shattering of the pill halves before they are consumed by the user.

In another aspect, the invention provides a method for evenly splitting pill units into uniform doses that comprises mounting a disc cassette element on a spindle in the base of a pill cutter of the invention; selecting a pill cavity of the disc that corresponds to the size and shape of a pill to be split; rotating the pill cavity to a position beneath and perpendicular to the cutting blade edge; locking the disc in place on the spindle and closing the cover to unsheathe and engage the blade with the center of the pill, and cutting the pill unit into two uniform dosage portions.

The invention further provides a method for evenly and accurately splitting multiple sizes and shapes of pills.

In yet another aspect, the invention provides a method of treating humans by dispensing uniform, reduced doses of therapeutic medications.

In another aspect, the invention provides a method of treating animals by dispensing uniform, reduced doses of therapeutic veterinary medications.

DESCRIPTION OF EMBODIMENTS

Figure 1:
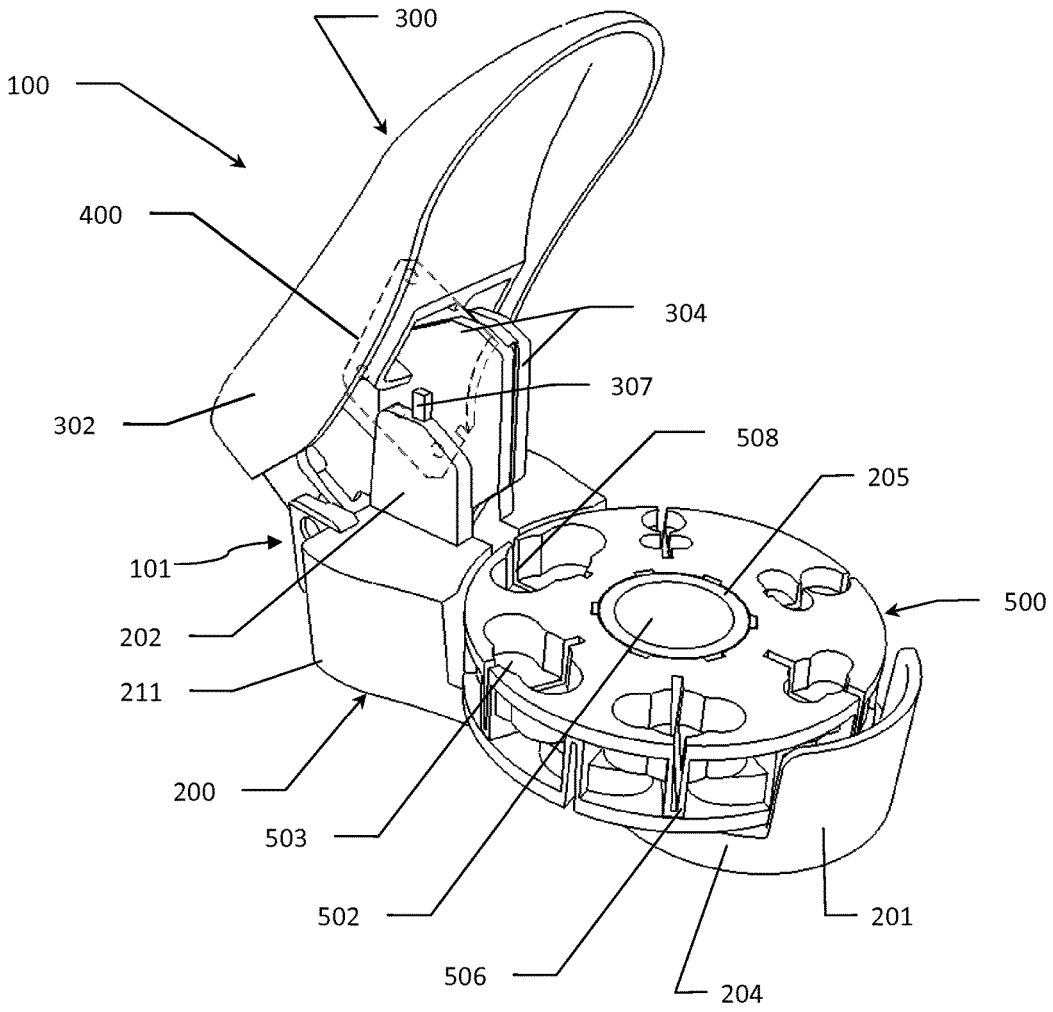
FIG. 1 is a perspective view of a pill cutter in an open position and showing a rotatable pill cassette according to the invention.

The invention comprises a pill cutter that incorporates a rotatable pill cassette equipped with pill cavities of different shapes and sizes. The cassette itself may be molded as a single structure with one or two sides, or it may be formed as two parts that may be assembled, disassembled and/or reassembled cooperatively to provide cassettes with different pill cavity sizes and shapes as well as cavity arrangements. When mounted on the housing of the pill splitter, the pill cassette functions to receive and secure a single pill unit and hold it in alignment with the cutting plane of a blade edge which, when activated by pressure, severs the pill into equal and uniform dosage portions. Many pill cutters currently on the market have a "V" shaped or similar area in the base where the pill is placed. In this area is an opening through which a razor blade passes and cuts the pill. Additionally, these cutters move the blade in such a manner so as to "chop" the pill. This universal sizing of the V-shaped pill holder assembly results in pills being cut unevenly, and the chopping effect of the blade leaves residue, or even breaks the pill in many pieces. The present invention provides an improvement over such pill cutters by providing means to receive and contain individual pills according to their size and shape. The more precise selection of size and shape minimizes their movement so that the pieces do not go flying when it is cut. As a result, the pill portions are not subject to shattering from impact with internal surfaces of a pill cutter. The invention also provides an improvement over pill cutters having a single pill size receptacle in that the rotatable pill cassette of the invention can be rotated to select different pill sizes without requiring an alternate cutter or substitute parts.

As shown in FIGS. 1-5, in certain preferred embodiments a pill splitter 100 of the present invention comprises a housing 200, a cover 300, a retractable blade 400 and a rotatable pill cassette 500 with multiple pill 503 cavities having multiple different shapes and sizes. The housing 200 includes a housing deck 204 which is integrally formed with housing rear supports 211 and a housing front wall 201. Hinges 101, which are attached to the exterior of the rear housing supports 211, are each comprised of a slot 212 in housing hinge tab 210 that is configured to receive peg 103 of the corresponding cover hinge tab 102.

Figure 2:
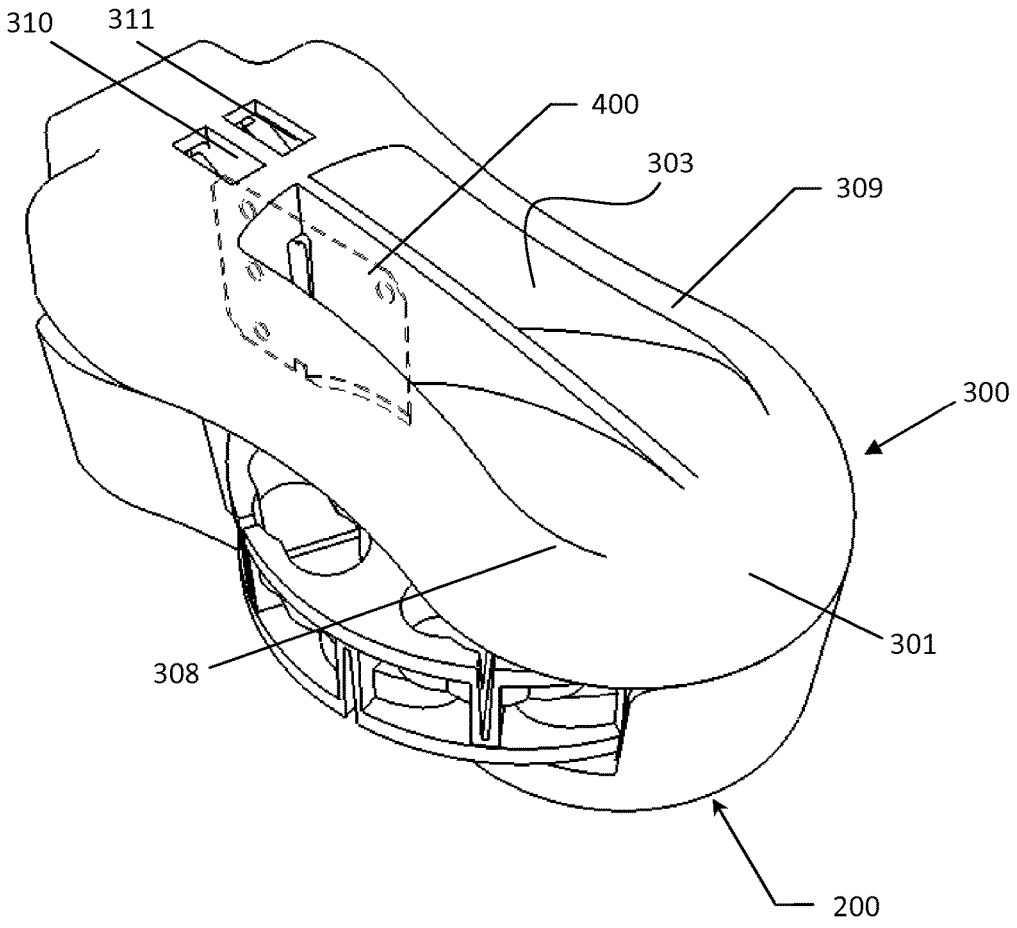
FIG. 2 is a perspective view of a pill cutter of the invention with the cover in closed position.
Figure 3:
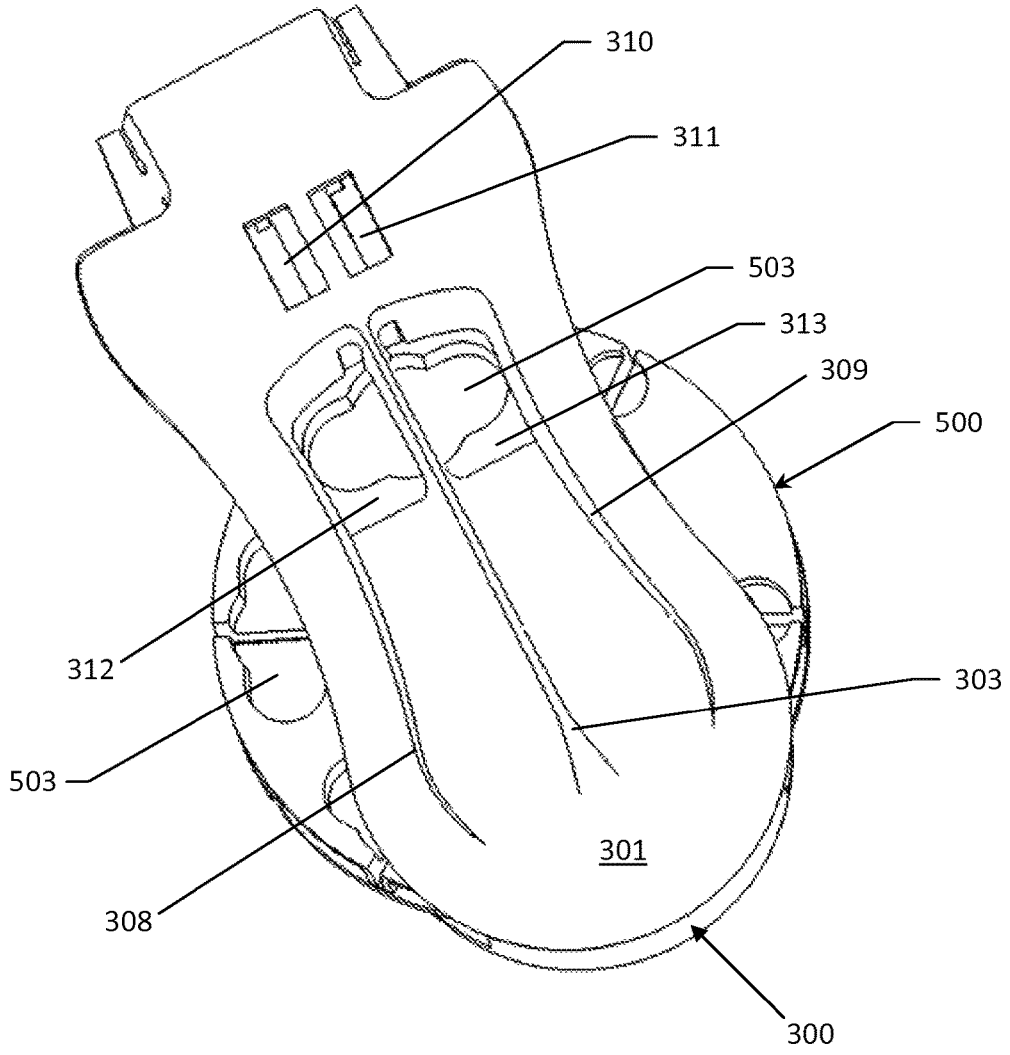
FIG. 3 is a top planar view of a pill cutter according to the invention.

The cover 300 may be formed of an opaque or transparent material, such as a clear acrylic or polycarbonate material. Preferably, the cover is molded as a cover upper wall 301 and cover side walls 302, with ridges 308, 309 that define openings for finger access to retrieve cut pill portions (FIG. 3). A center ridge portion forms a blade housing 303 that has formed therein an internal slot that provides a track for backward or forward movement of the blade 400. A peg 306 disposed between and positioned within cam slots 305 enable the upward and downward movement of these guards in relation to the blade. The blade housing 303 also forms a grip for opening the pill cutter. As shown in FIG. 1, the cover 300 is attached to the housing 200 via engagement of cover hinge tabs 102 with the slot 212 of corresponding housing hinge tabs 210, for example as a male-female peg and slot closure (elements 103, 212). As shown in the embodiments of FIGS. 2 and 3, slots 310, 311 are features that allow for thermoplastic molding but are not required for functionality in the cover upper wall of the housing 200 that provides stabilization for the blade 400.

As seen in FIG. 3, the access ports 312, 313 are formed as depressions within the cover over a selected pill cavity 503 that capture and contain the cut pill portions, allowing them to be manually removed. The access ports also prevent the pill portions from being projected out of the pill cutter as the pill is severed. The contents of the access ports can be viewed and accessed while the cover 301 is closed.

Figure 4:
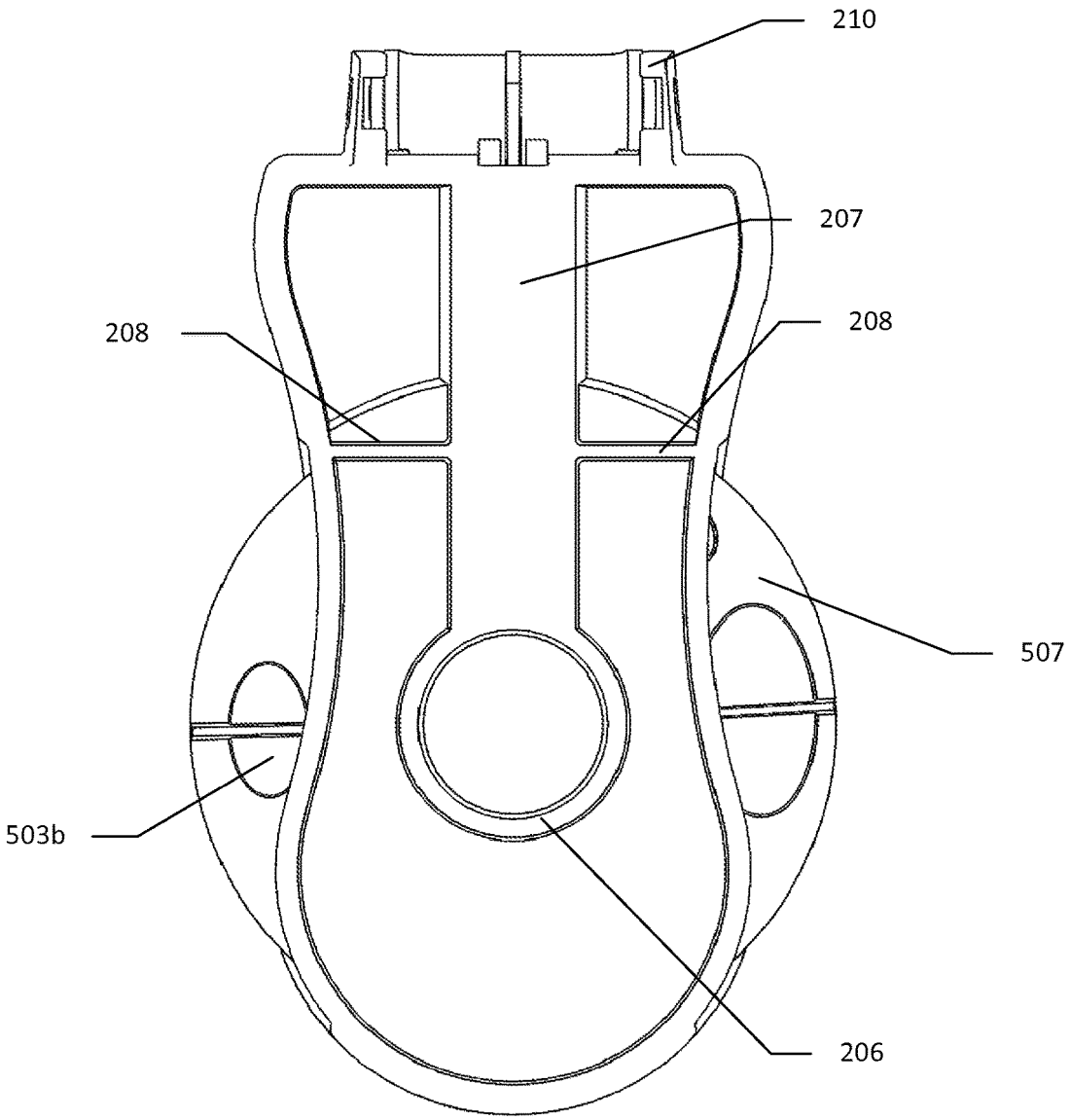
FIG. 4 is a planar view of the underside of an embodiment showing the housing support rib.

According to FIG. 4, the housing 200 is stabilized by a housing support rib 207 that is located along and parallel with the vertical axis of the pill splitter. The rib 207 is preferably integrally formed, e.g. by molding, with the housing. This rib strengthens the housing and prevents twisting or deformation of the housing in response to the cutting pressure of the blade. The rib 207 is further stabilized by perpendicularly placed lateral ribs 208, which provide further support at approximately the center of the housing support rib 207. The housing front wall 201 provides additional structural support and containment for the rotatable pill cassette 500.

Figure 5:
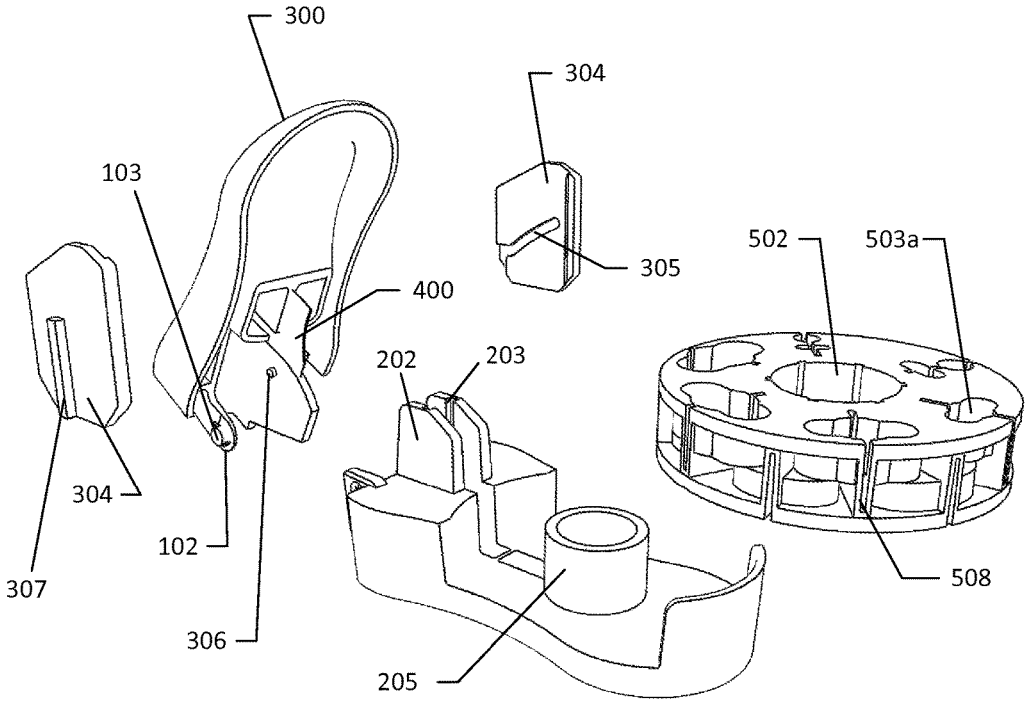
FIG. 5 is an exploded perspective view of a pill cutter according to an embodiment of the invention showing the cooperation of the rotatable pill cassette and the base of the pill cutter.
Figure 6:
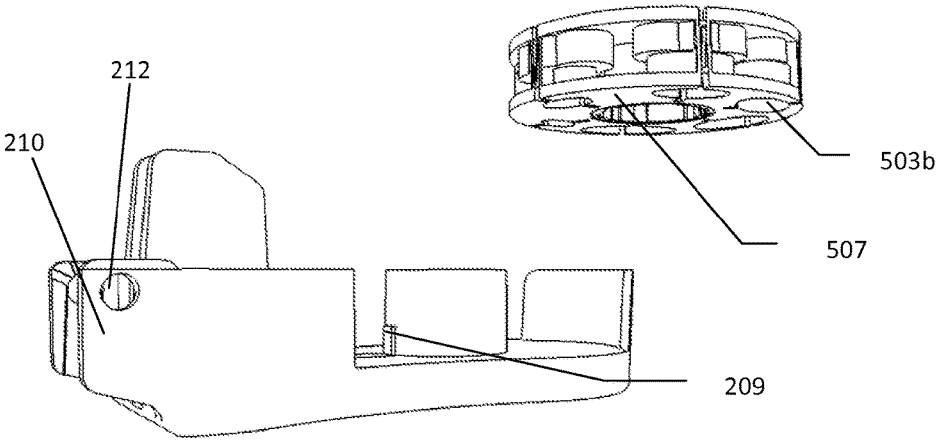
FIG. 6 is a perspective view of the rotatable pill cassette and locking feature of the base according to an embodiment of the invention.
Figure 7A:
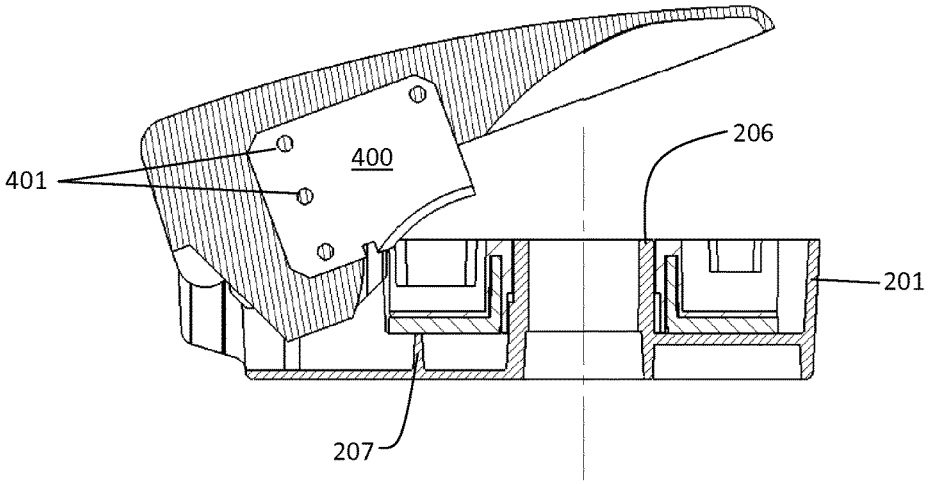
FIGS. 7A and 7B are transverse sectional views of a pill cutter of the invention in the open and closed positions, respectively, while FIG. 7C provides a perspective transverse sectional view.
Figure 7B:
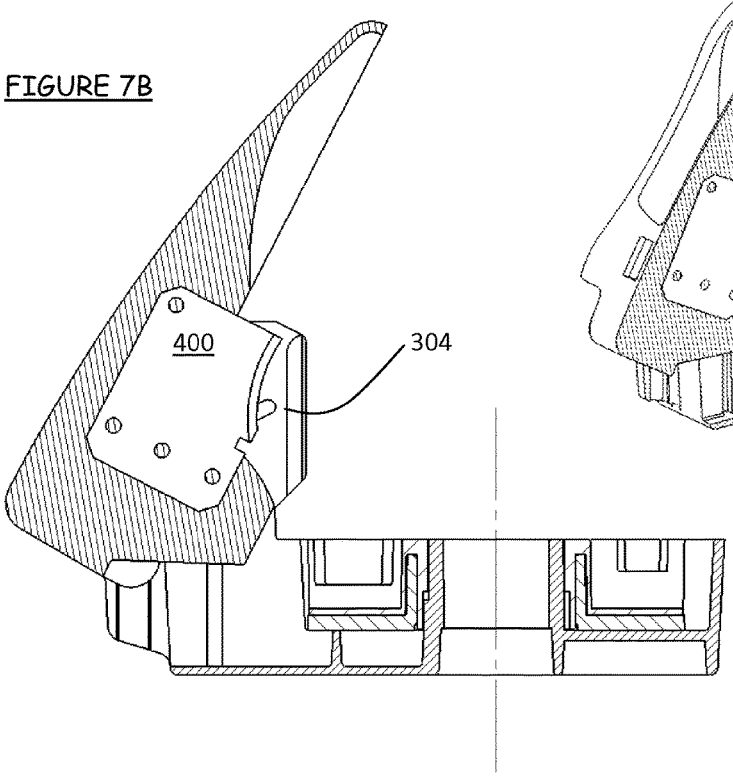

FIG. 5 is an exploded view that illustrates assembly and operation of the pill splitter parts. As seen in FIG. 5 (and FIG. 1), a metallic blade 400 is sheathed between retractable blade guards 304. These blade guards are slidably attached to blade slot walls 202 of the housing and move in relation to the slot walls 202 by means of keys 307 (posts) that slide in slots 203 on the inner surface of the blade slot walls 202 so as to guide the blade guards 304 up and down. Hinge pegs 103 move by rotating or sliding in the slots 212 of hinge tabs 210, in cooperation with the vertical movement of the keys 307 to open the cover 300 (see FIG. 6). In operation, the cover preferably opens to an angular range of between 60 and 75 degrees, preferably between 60 to 65 degrees. The cover is stopped at the desired angle by the maximum engagement of the keys with the slots 203. As seen in FIGS. 7A and 7B, the blade 400 is retracted between the oppositely positioned, reciprocal and retractable blade guards 304 (also shown in FIG. 5) when the pill cutter is open. By means of the keys 307, the blade guards 304 move upward as the cover is opened, thereby occluding the edge of the blade 400. As the cover is closed, the guards 304 are moved downward to expose the blade edge for cutting. The retractable operation of the blade provides a safety feature for the user, as the blade is fully sheathed while the cover of the pill cutter is open.

Figure 7C:
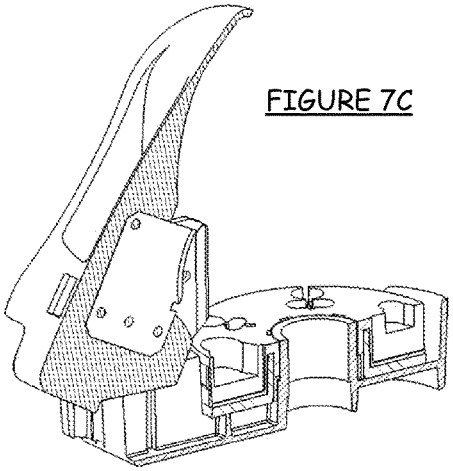

The blade 400 is a retractable blade with a graduated bevel edge 402. The blade is disposed within the housing. While conventional pill cutter blades are of an approximate thickness of 0.0015 inch or more, the blade used in the invention is preferably less than 0.0014 inch, preferably about 0.0012 inch thick. The blade edge 402 is, in a preferred embodiment, curved. The curved shape enables the blade to contact the pill from the outside surface, which is usually curved, and thus operates by slicing the pill rather than chopping it, as is achieved by conventional pill cutter blades. This slicing action reduces shattering, breakage and generation of residue. In certain embodiments, the blade may be molded into the cover 200. A preferred material for the blade is stainless steel or a similar corrosion or wear resistant material. In various embodiments, the curved blade edge may have a very large radius, which increases the linearity of the edge at an angle. This provides an angle of engagement of the blade with the pill surface that is not observed in conventional pill cutters. It should be understood that in certain modifications, however, the blade may also be linear, provided that the cutting angle is retained, along with the bevel and/or reduced thickness. The blade may be embedded during the molding process. A plurality of holes 401 in the blade (according to the embodiment of FIGS. 7A, 7B) receive the plastic melt during the mold-in process, which aids in creating a strong bond between the metal blade and the plastic cover. As shown in the perspective view of FIG. 7C, the blade is co-planar with the vertical and horizontal medians of the apparatus 100.

Figure 8B:
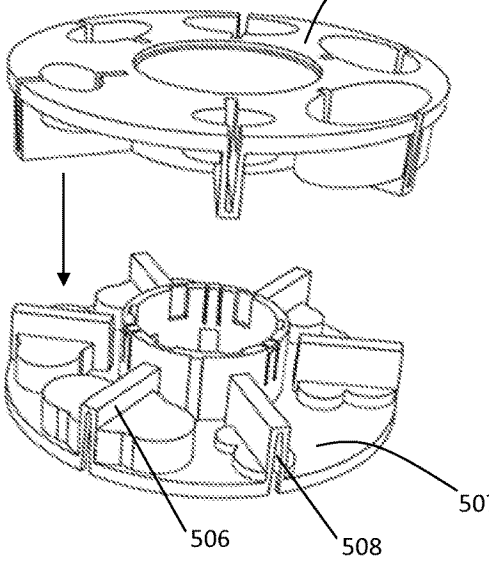
FIGS. 8A, 8B and 8C are perspective views of the top and underside of portions of a pill cassette according to the invention.
Figure 8A:
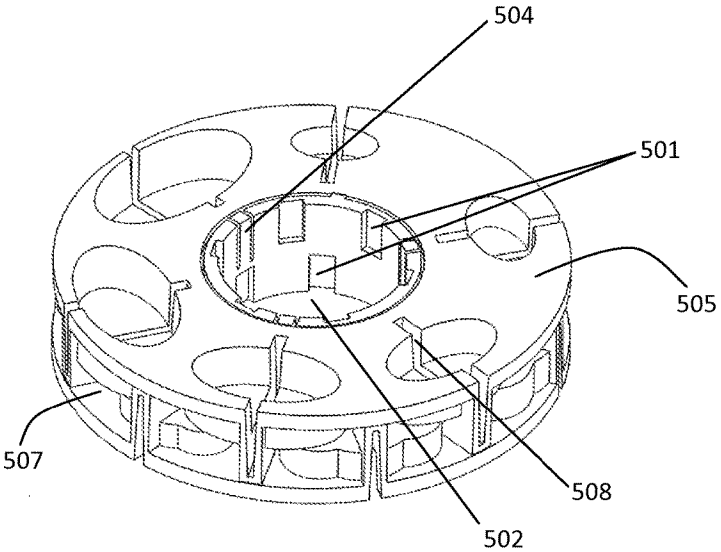

FIG. 8A shows an exemplary embodiment of an assembled pill cassette 500. The cassette is in this embodiment disc-shaped and configured like a wheel, with pill cavities 503 (either 503*a* or 503*b* relative to the top and bottom cassette portions, respectively) of selected sizes and shapes on one side, and additional cavity shapes of varying size on the other side. The cassette may be of any other three-dimensional shape, provided that it is rotatable and can be mounted on the pill splitter housing. As represented by FIGS. 8B and 80C, a first portion, for example an upper half (top side) 505 and a second portion, for example a lower half (under side) 507 of the cassette 500 may be separately formed or molded and then assembled, for example by friction fit, gluing or other locking mechanism.

An exemplary, preferred locking mechanism includes slots 501, locking tabs 504, as well as an alignment locking slot 509 on one side, for example on the lower half 507, which engages with an alignment key 510 and ridges 506 formed by the undersides of pill cutting slots 508 to firmly lock the two portions of the pill cassette together. The locked portions of the cassette thus fit securely together and do not move in relation to each other. It should be understood that the configuration of each portion may be assembled in reverse, i.e. the portions designated as top and bottom portion herein may be reversed for assembly and mounting on the housing of the pill cutter 100.

Further, by example, one (upper) portion 505 of the cassette may hold pills up to approximately 0.9 inches in length and up to approximately 0.5 inches in maximum width. In this respect, according to FIG. 8A, six sizes from the smallest commonly prescribed pill to the largest are provided in small increments. This embodiment combines circular and oval shaped or cylindrical shapes to make pill cavities 503*a* on one side, so that the cavity may be used to hold either an oblong, oval or round pill unit, providing the unit is of corresponding width. This exemplary embodiment uses this method of combining shapes to make the best use of the circular area of the cassette to provide pill cavities for or as many oval, cylindrical and round shaped pills as possible. FIG. 8B shows the opposedly formed underside portion 507 of the pill cassette, which includes additional pill cavities 503*b* of different shapes and sizes. As an example, these cavities may be shaped and sized to hold ellipsoidal pills up to approximately 0.9 inches long. Various sizes of ellipsoidal pills are held in place in the cavities 503*b*. All other features of the cavities 503*b* of this side serve the same purpose as the pill cavities 503*a* on the top side of the pill cassette. In the preferred embodiment of FIGS. 8A-C, the two smallest cavity positions have separate oval and circular cavities for easier use. The pill cavities are preferably arranged in a staggered fashion on either side of the cassette. In this way, shallow pill cavities on one side are juxtaposed against deeper cavities on the alternate side so as to keep the overall height of the disc as small as possible and to maintain the stability of the separate, interlocked cassette portions. Additionally, spacing between the pill cavities is carefully arranged to allow placement of the locking tabs 504 which hold the upper and lower sides of the cassette together and in turn secure the cassette to the housing.

Figure 8C:
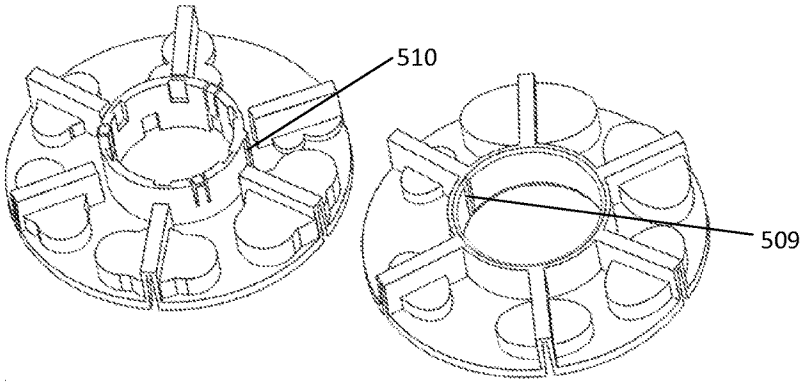

As further shown in FIGS. 8A-C, each pill cavity 503 is bisected by a cutting slot 508 that provides for passage of the blade through the cavity to cut the pill. When properly mounted on the housing 200, the slot 508 aligns with the blade. A cylindrical or tubular protrusion or boss forms a cassette mount 205 on the base of the housing 200 (FIG. 5). The mount 205 is positioned perpendicular to the base and to the plane of the horizontal plane of the pill cassette 500. A key stop 209 on the outer circumference of the cassette mount 205 forces alignment of the pill cassette with blade housing 303. In this respect, one or more locking slots 501 are disposed around the inner circumference of the mounting hole 502, each of which may, as selected, engage with the key stop 209 to lock the pill cassette in place. Additionally, locking tabs 504 engage with the ridges 506 formed on upper and lower cassette portions by the undersides of cutting slots 508, and an alignment key 510 further cooperates with an alignment locking slot on the upper cassette portion 505. These locking features together hold the two halves of the pill cassette together securely for mounting on the housing of the pill splitter. This alignment securely holds the pill cassette and pill cavity in place beneath the pill splitter blade.

EXAMPLE 1

Figure 9A:
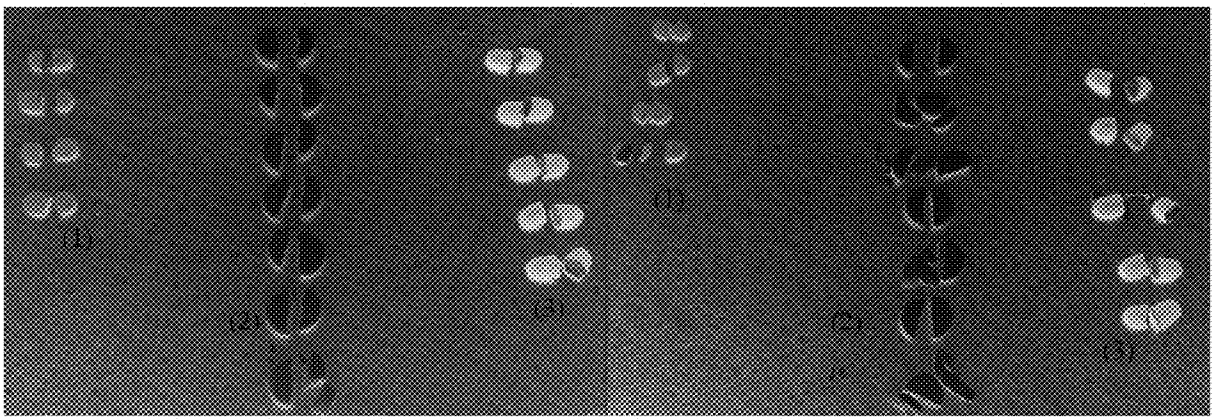
FIGS. 9A and 9B are photographs showing the results of cutting pill units of common drug medicaments with a pill splitter according to the invention, as compared to using a commercially available conventional pill cutter.
Figure 9B:
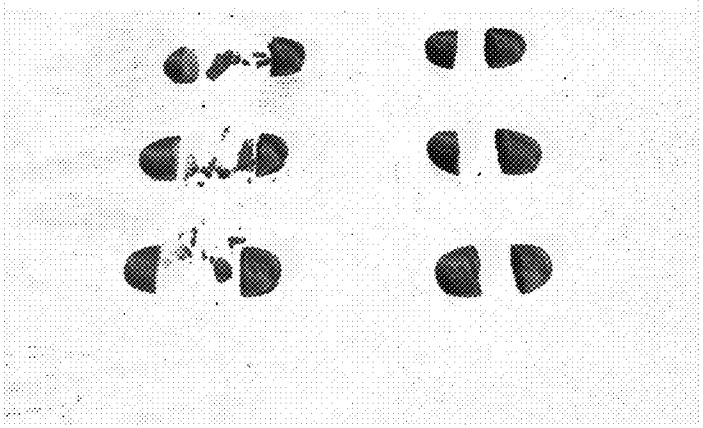

In the comparative evaluation of a multi-size pill splitter according to the invention, a selected number of medicament tablets were cut into halves using the invention (Device A) and a pill cutter device having a V-shaped pill holder assembly sold by Apothecary Products, LLC, Burnsville, Minn. (Device B). Representative results are shown in Table 1, below, and in FIGS. 9A and 9B. FIG. 9A includes visible observations for cut samples of (1) diphenhydramine, (2) oxycodone and (3) ibuprofen, respectively. Illustrated in FIG. 9B are additional results for cutting samples of a generic cold mucus medication that were also cut using the invention and the comparator Device B.

TABLE 1

| Pill Cutter Device | Drug Tablet | Original Size (pre-cut) - Cut Size | Results |
|---|---|---|---|
| Device A | Diphenhydramine (1) | 4 whole tablets to halves | 4 of 4 tablets split; no residue or breakage |
| | Oxycodone (2) | 7 whole tablets to halves | 6 of 7 tablets split; no breakage, no residue |
| | Ibuprofen (3) | 5 whole tablets to halves | 5 of 5 tablets split, no residue or breakage |
| | Generic cold mucus medication | 3 whole tablets to halves | 3 of 3 tablets split, no residue or breakage. |
| Device B | Diphenhydramine (1) | 4 whole tablets to halves | 1 of 4 tablets showed significant breakage, residue |
| | Oxycodone (2) | 7 whole tablets to halves | 2 of 7 tablets split without residue; 5 tablets broke into multiple fragments |
| | Ibuprofen (3) | 5 whole tablets to halves | 3 of 5 tablets split without visible residue; residue observed for 2 tablets |
| | Generic cold mucus medication | 3 whole tablets to halves | 3 of 3 tablets showed extensive fragmentation and visible residue. |

EXAMPLE 2

A multi-size pill splitter according to the invention (Device A) was used to split pill halves of oxycodone, a prescription narcotic medication, into quarters. Half portions of pills of the same drug were also split, for comparison, using the pill cutter with a V-shaped pill holder assembly used in Example 1 (Device B), and a pill cutter/crusher device (Device C), both sold by Apothecary Products, LLC, Burnsville, Minn. The results observed after cutting the samples are reported in Table 2, below.

TABLE 2

| Pill Cutter Type | Number of Samples Cut | Results After Quartering |
|---|---|---|
| Device A | 7 | 7 cuts, no residue |
| Device B | 2 | 2 unsuccessful cuts; large, residue |
| Device C | 4 | 3 successful cuts; 1 unsuccessful cut, large residue |

In a method of use, the user opens the pill cutter and chooses a pill cavity in the pill cassette that matches the size and shape of the pill unit to be cut. In this regard, the pill unit may also be a pill half or other portion to be further divided. The pill unit is placed in the pill cavity. The cassette is then mounted on the housing by sliding the mounting hole 502 over key stop 209 of the cassette mount 205 on the housing. This forces alignment of the selected pill cavity 503 with the blade 400.

The foregoing described invention may be used to split prescription pills having a nominal diameter between 0.2 and 0.5 inches, and nominal length between 0.25 and 0.9 inches. However, it is recognized that a number of alternative standard pill sizes and shapes are available, and the pill cassette and pill cutter of the assembly may be adapted to such products as well. Accordingly, varied dimensions, materials, and manufacturing techniques may be applied to configure pill splitters according to the invention that conform to such pills. Preferably, the dimensions, materials, and manufacturing techniques herein include other suitable characteristics, such as strength, durability, light weight, temperature-resistance, chemical inertness, oxidation resistance, or other beneficial characteristics understood by one skilled in the art.

The foregoing description of specific embodiments is not intended to be limiting on the scope of this disclosure, but rather to be illustrative of the broad concepts embodied by this invention. Those skilled in the art will appreciate that the present invention contemplates the various embodiments of the invention herein described as well as equivalents thereof. Those or ordinary skill in the art will also appreciate that the scope of this invention should be measured by the attached claims as well as by the embodiments herein described.

INDUSTRIAL APPLICABILITY

A very large demographic of consumers is required to take prescription or non-prescription drugs in pill form for all kinds of reasons. Pill usage is expected to increase as the global population continues to live longer in both the industrial and emerging countries of the world, and accordingly, the need for modified dosages will continue to increase. The invention satisfies this demand by providing a pill splitter and methods that cut pills into uniform dosages with greater accuracy and reduced breakage. The invention is intended for use with solid dose forms that can be split without reduced or negative therapeutic effect, and not for capsules, or pills or tablets of timed release medications.

The invention claimed is:

1. A pill splitter for dividing pills into uniform dosage portions for treating humans or animals comprising:

a. a housing, which includes a cassette mount arising perpendicularly from the base of the housing;

b. a cover including access ports disposed therein for retaining and removal of portions of a pill unit;

c. a rotatable pill cassette having a top side and an under side each disposed on opposing sides of the rotatable pill cassette and each of which may be separated one from the other; said each of the top side and under side having disposed therein multiple pill cavities disposed to hold pills of different shapes and sizes; and further wherein the rotatable pill cassette is mounted on the cassette mount;

d. a blade disposed within the housing which is proximally located in relation to and which moves upward or downward in an arc with the opening or closing of the cover; and e. a retractable blade within the blade sheathed between retractable blade guards, which is unsheathed and extended downward in an arc through the blade housing to pass through the center line of the pill cavity when the cover is closed.

2. The pill splitter of claim 1 wherein each of the pill cavities of the rotatable pill cassette is traversed by a pill cutting slot corresponding to the center dividing line of the pill unit.

3. The pill splitter of claim 1 wherein the rotatable pill cassette further comprises a disc mounting hole and locking slots around the periphery of the disc mounting hole, and the pill cassette is aligned on the housing by aligning with a key stop on the cassette mount.

4. The pill splitter of claim 1, wherein the rotatable pill cassette has a circular shape.

5. The pill splitter of claim 1, wherein the retractable blade has a curved and beveled edge.

6. The pill splitter of claim 1 wherein the top side and under side of the rotatable pill cassette are reversed, assembled and mounted on the cassette mount.

7. A method of splitting pills to provide reduced, uniform doses using a pill splitter according to claim 1, comprising the steps of:

a. selecting a pill unit to be cut into uniform doses, b. selecting a pill cavity of a rotatable cassette and placing the pill in the selected cavity, c. closing the cover of the pill splitter to unsheathe and engage the retractable blade with the center dividing line of the pill cavity, thereby cutting the pill unit into equal portions, and d. removing the cut pill portions from the access ports within the cover of the pill splitter.

8. A method of splitting pills according to claim 7, in which the rotatable pill cassette is disassembled by separating the top side from the under side; the top side and under side are reversed and reassembled to provide the former top side as the under side, and the former under side as the top side; and the reassembled cassette is placed on the cassette mount to change the size of the pill cavity exposed for use.

9. A rotatable and removable pill cassette for use in a pill splitter comprising a first portion having configured therein multiple pill cavities, pill cutting slots traversing the pill cavities and an alignment locking slot, and a second portion having configured therein multiple pill cavities, pill cutting slots traversing the pill cavities and locking tabs; in which the first portion and the second portion are joined together to assemble the pill cassette by alignment of the alignment locking slots and the locking tabs.

10. A pill splitter which includes a pill cassette according to claim 9.

11. A method of splitting pills using a rotatable pill cassette according to claim 9.

* * * * *